United States Patent [19]

Berrill et al.

[11] 4,435,869

[45] Mar. 13, 1984

[54] SHOE LASTING MACHINES

[75] Inventors: William H. Berrill, Leicester; Herbert W. Boot, Thurmaston; Frank Hartshorn, Wigston, all of England

[73] Assignee: USM Corporation, Farmington, Conn.

[21] Appl. No.: 239,210

[22] Filed: Mar. 2, 1981

[30] Foreign Application Priority Data

Mar. 22, 1980 [GB] United Kingdom ..... 8009771

[51] Int. Cl.[3] ..... A43D 21/00

[52] U.S. Cl. ..... 12/12

[58] Field of Search ..... 12/12, 8.5, 9, 10, 10.1, 12/10.2, 10.21, 10.3, 10.4, 14.5

[56] References Cited

U.S. PATENT DOCUMENTS 2,778,039 1/1957 Hubbard ..... 12/12

3,651,526 3/1972 Ogawa ..... 12/12

4,296,513 10/1981 Halford et al. ..... 12/12

*Primary Examiner*—Patrick D. Lawson

*Attorney, Agent, or Firm*—Donald N. Halgren

[57] ABSTRACT

Provision is made for enabling the support for the lasting rolls and/or adhesive applying nozzles to be moved initially either into a position in which the instrumentalities are aligned with the longitudinal center line of the machine or alternatively are offset therefrom, selectively according to the contour of the shoe bottom. Further, the support is moved from its initially selected position to the other position during the machine cycle, thereby, in the case of the lasting rolls, varying their position during the machine cycle according to the shoe bottom shape. In the case of the nozzles, on the other hand, once they have engaged the shoe bottom, they are released from any constraint of their widthwise movement and are thus free to follow the shoe bottom edge contour, regardless of the position of the support.

18 Claims, 9 Drawing Figures

SHOE LASTING MACHINES

BACKGROUND OF THE INVENTION (1) Field of the Invention

This invention is concerned with machines for lasting side portions of shoes.

(2) Prior Art

Machines for lasting side portions of shoes comprise a shoe support arrangement by which a last carrying a shoe upper and an insole can be positioned and which includes means to position the shoe in a desired relationship with the longitudinal center line of the machine, instrumentalities for operating on side portions of a shoe supported by the shoe support arrangement, and means for effecting relative movement between the shoe support arrangement and said instrumentalities in a direction extending lengthwise of a shoe supported by the shoe support arrangement, whereby the instrumentalities are caused to operate progressively along opposite side portions of such shoe. One such machine is described in detail in U.S. Pat. No. 3,849,817, and in such machine instrumentalities in the form of two lasting rolls, each rotatable about an axis extending widthwise of the bottom of a shoe supported by the shoe support arrangement and each being provided with a wiping element disposed helically about the circumference thereof, are provided and also instrumentalities in the form of two adhesive applying nozzles, the arrangement being such that, as relative movement is effected between the shoe support arrangement and said instrumentalities as aforesaid, adhesive can be applied progressively by said nozzles along opposite side portions of the shoe between lasting marginal portions of the upper and corresponding marginal portions of the insole thereof, the application of adhesive as aforesaid preceding the operation of the lasting rolls by which the upper is drawn about the last and the lasting marginal portions thereof pressed against corresponding marginal portions of the insole, to which they thus become secured by the applied adhesive.

In this prior art machine, the lasting rolls are arranged to be positioned symmetrically at opposite sides of the longitudinal center line of the machine, the dimension of each roll in a direction widthwise of the shoe being operated upon being sufficient to ensure that the edge contour of each side of the shoe bottom can be accommodated without the need for any widthwise shifting of the roll during the operating cycle. In practice, the rolls are spaced apart from one another by a distance sufficient to ensure that, where the shoe bottom being operated upon is provided with a metal shank, the rolls will not foul on such shank in lasting the shank region of the shoe bottom.

Whereas the aforementioned arrangements has proved satisfactory with a majority of shoe bottoms to be lasted, nevertheless the bottoms of shoes of certain styles are so shaped that they cannot be effectively and reliably lasted when the lasting rolls are in a fixed position widthwise of such shoe bottom. Thus, for example, it may be that the forepart portion of such shoe bottom is so offset from a line passing through the shank region, which line is utilized for initially positioning the shoe in the machine, that the lasting roll for operating on the "outside" of the shoe bottom shape will not adequately cover the lasting marginal portions of the upper to be lasted, or indeed may fail to engage with the shoe bottom at all as relative heightwise movement is effected between the rolls and shoe bottom to bring them into engagement with one another at the start of a machine cycle. Again, in certain shoe styles where the shank region is very narrow, positioning the shoe with the longitudinal center line of its shank region coincident with the longitudinal center line of the machine may give rise to the lasting roll operating on the "inside" of the shoe bottom failing to engage the lasting margin portions of the shoe upper as it tracks along the shank region.

With a view to overcoming the above difficulties, it has already been proposed as suggested in U.S. Pat. No. 3,591,878, to move the side lasting rolls widthwise of the shoe bottom, as the rolls are caused to operate progressively along the sides thereof, according to the edge contour of the shoe bottom. In order to achieve such widthwise movement, however, it is necessary to provide guide means, e.g. in the form of a template, and of course a different template is required for each shoe style, this giving rise to storage problems. Furthermore, either the machine has to be provided with a grading mechanism so as to enable a single style template to be used or a size range, or alternatively a plurality of templates are required for each style to cover the range of sizes.

Again, in the first-mentioned machine, nozzles, which are mounted for movement, independently of one another, in a direction extending widthwise of the bottom of a shoe supported by the shoe support arrangement, are located adjacent one another, symmetrically at opposite sides of the longitudinal center line of the machine, at the start of an operating cycle thereof, and thereafter, when relative heightwise movement has been effected between the nozzles and the shoe bottom to bring them into engagement with one another, the nozzles are moved outwardly to a position determined by the edge contour of the shoe bottom, prior to relative movement being effected, in a direction extending lengthwise of said shoe bottom, between the shoe support arrangement and the nozzles, thus to cause adhesive to be applied progressively as aforesaid. Where, however, the foreport portion of the shoe bottom is significantly offset from the longitudinal center line of the shank region of the shoe bottom, the problem may arise that, with the nozzles adjacent one another as aforesaid, the nozzle which is to apply adhesive along the "outside" of a the edge contour may either engage the lasting margin of the upper as the nozzle contacts the shoe bottom, or even miss the shoe bottom entirely. Furthermore, in said machine the positioning of the nozzles adjacent one another as aforesaid is achieved by stop means which limits the movement of each nozzle inwardly towards the other, the arrangement being such that the nozzles are thus unable to cross the longitudinal center line of the machine as they are caused to follow the edge contour of the shoe bottom being operated upon. Where the shoe bottom contour is exaggerated, however, it may be necessary especially for the nozzle which operates along the "inside" of the shoe bottom to cross said longitudinal center line of the machine.

In U.K. Pat. No. 1,454,939 a support arrangement for supporting two cement applying nozzles is disclosed, said arrangement comprising a support mounted for pivotal movement about a vertical axis between a first, centralized position and a selected one of two second, offset positions, the arrangement being such that, at the start of an operating cycle of the machine, the support is moved from its first position to one of its second positions (selected according to whether the shoe to be operated upon is a left or a right) prior to the nozzles being located against the insole of such shoe, and thereafter, during the course of the operating cycle, the support is allowed to move freely between its two second positions according to the edge contour of the shoe bottom. Furthermore, the nozzles are mounted on said support for movement, independently of one another, in a direction extending widthwise of the shoe bottom, such movement of the nozzles, towards each other, being limited by stop means, which thus serve to position the nozzles adjacent one another for the start of the operating cycle. In this case, however, the stop means are not withdrawn after the nozzles are located in contact with the insole of a shoe to be operated upon, so that any movement of one of the nozzles across the longitudinal center line of the machine must be accommodated by movement of the support; hence the need for the support to pivot freely during the operating cycle. Such an arrangement is clearly complicated insofar as it requires stop means for the nozzles as well as centralizing means for positioning the support in its first position. In addition, allowing the support to pivot freely during the operating cycle restricts the uses to which such support can be put; e.g. it could not thus be used to support lasting rolls.

It is the object of the present invention to provide an improved machine for lasting side portions of shoes, in the operation of which machine the aforementioned disadvantages are overcome and the range of shoe styles which can be operated upon is thus extended.

BRIEF SUMMARY OF THE INVENTION

The invention thus provides a machine for lasting side portions of shoes comprising a shoe support arrangement by which a last carrying a shoe upper and an insole can be positioned and which includes means serving to position the shoe in a desired relationship with the longitudinal center line of the machine, instrumentalities for operating on side portions of a shoe supported by the shoe support arrangement, and means for effecting relative movement between the shoe support arrangement and said instrumentalities in a direction extending lengthwise of a shoe supported by the shoe support arrangement, whereby the instrumentalities are caused to operate progressively along opposite side portions of such shoe, wherein the instrumentalities are mounted on a support which is movable between a first position, in which the instrumentalities can be positioned symmetrically at opposite sides of the longitudinal center line of the machine, and a second position, in which said instrumentalities can be positioned offset from said line and support-moving means is provided for moving the support between its first and second positions, the arrangement being such that the support is positioned in a selected one of its first and second positions at the start of an operating cycle of the machine and is moved by the support-moving means to the other of said positions during said operating cycle.

It will thus be appreciated that the versatility of the machine is significantly increased by enabling the instrumentalities to be moved together, under control, widthwise of the bottom of a shoe being operated upon, to accommodate any exaggerated edge contour shapes of various shoe bottoms being operated upon, especially at the start of an operating cycle of the machine.

Customarily, machines of the type in question are capable of operating upon both left and right shoes, and often they are arranged to operate upon left and right shoes alternately. To this end, therefore, preferably the support for the instrumentalities is movable between its first position and a selected one of two second positions, in each of which said instrumentalities can be positioned offset from said longitudinal center line of the machine, said second positions being arranged symmetrically at opposite sides of the first position, and the arrangement being such that the support is caused to move as aforesaid during an operating cycle of the machine between its first and a selected one of its second positions according to whether the shoe to be operated upon is a left or a right.

The support-moving means, by which the support for the instrumentalities is moved between its first and second positions as aforesaid, may comprise cam means, said cam means in turn preferably comprising a cam member having two cam faces and means for moving said member so as to enable one or other of said faces to be engaged by an abutment member, the arrangement being such that, in an operating cycle of the machine, relative movement is caused to take place over a predetermined distance between the cam member and the abutment member between a first operative position in which they are out of engagement with one another (in which position the support for the instrumentalities is in its first position) and a second operative position in which the abutment is located in engagement with one or other of the cam faces, and further that, with the cam member and abutment member in such second operative position, when one of said cam faces is engaged by the abutment member said support is in one of its second positions, and when the other cam face is so engaged, said support is in the other of its second positions. More specifically, the cam means also conveniently comprises a cam plate having a cam slot in which the abutment member is accommodated, the arrangement being such that the cam member is moved in relation to the cam slot so that one or other of its cam faces projects into said slot and can be engaged by the abutment member as aforesaid, the cam means preferably comprising fluid pressure operated means for effecting relative movement between the cam plate (and thus the cam member) and the abutment member between said first and second operative positions. Preferably also the means for moving the cam member as aforesaid is also fluid pressure operated. Conveniently, the cam plate is fixedly connected to the support for the instrumentalities and the abutment member is carried by the fluid pressure operated means.

The support for the instrumentalities may be mounted for pivotal movement between its first and second positions. Alternatively, it may be mounted for sliding movement bodily between said position. In this latter case, the support-moving means may alternatively comprise two pusher members, e.g. two fluid pressure operated piston-and-cylinder arrangements, acting on opposite ends of a lever pivotally connected to the support, for moving the support as aforesaid, the arrangement being such that with both pusher members in an extended condition the support is in one of its second positions, while with both pusher members in a retracted condition the support is in the other of its second positions, but with one pusher member in an extended and the other in a retracted condition, the support is in its first position.

Valve means is pivoted, for causing the support for the instrumentalities to be moved as aforesaid during the operating cycle, according to the operating mode to be executed, actuatable by cam means, as relative movement is effected as aforesaid between the shoe support arrangement and said instrumentalities in a direction extending lengthwise of a shoe supported by the shoe support arrangement. Furthermore, preferably the initial relative position between said cam means and said valve means is determined according to the size of shoe being operated upon, more specifically according to the position of the ball region of the bottom of the shoe being operated upon in relation to the shoe support arrangement by which it is supported.

The instrumentalities of the machine in accordance with the invention may comprise lasting rolls, each rotatable about an axis extending widthwise of the bottom of a shoe supported by the shoe support arrangement and each being provided with a wiping element disposed helically about the circumference thereof. In such a case, the versatility of the machine is significantly increased in that the lasting rolls can be moved bodily together widthwise of the bottom of a shoe being operated upon, but without the need for a template or like guiding means suited particularly to the style of shoe being operated upon.

Moreover, where the instrumentalities comprise such lasting rolls, the machine must be capable of operating in a number of different operating modes according to the style of shoe being operated upon. Thus, where the shoe bottom being operated upon is provided with a metal shank, it is positioned with a longitudinal center line of its shank region aligned with the longitudinally center line of the machine, the operation of the machine then being such that, at the start of an operation cycle, the support by which the lasting rolls are supported is in its second position (or in one of its second positions selected according to whether the shoe being operated upon is a left or a right) and is moved to its first position as the lasting rolls supported thereby are operating in the ball region of said shoe and approaching the shank region thereof.

On the other hand, in carrying out another operating mode, it may be desirable e.g. because of the offset condition of the forepart of the shoe bottom, for the shoe to be operated on to be positioned with a longitudinal center line of its shank region inclined to the longitudinal center line of the machine, and, in this case, in the operation of the machine, at the start of an operating cycle, conveniently the support by which the lasting rolls are supported is in its first position and is moved into its second position (or in one of its second positions selected according to whether the shoe being operated upon is a left or a right) as the lasting rolls supported thereby reach the shank region of said shoe.

Again, in carrying out a further operation mode, it may be desirable e.g. because of the narrowness of the shank region in combination with the offset condition of the forepart of the shoe bottom, for the shoe to be operated upon to be positioned with a longitudinal center line of its shank region extending parallel, or substantially so, to the longitudinal center line of the machine, but not coincident therewith, and, in such a case, preferably in the operation of the machine, at the start of an operating cycle, the support by which the lasting rolls are supported is in one of its second positions, selected according to whether the shoe being operated upon is a left or a right, is moved to its first position as the lasting rolls operate in the ball region of said shoe, and is thereafter moved to the other of its second positions when said lasting rolls reach the shank region of said shoe.

As an alternative arrangement in the case of the last-mentioned operating mode, where the support by which the lasting rolls are supported is mounted on a slide, it may be moved out of its selected second position to the other of its second positions (passing through its first position) as the lasting rolls supported thereby approach the shank region of the shoe. That is to say, it is not necessary, in such an arrangement, for the support to be arrested in its first position during the operating cycle.

In the machine in accordance with the invention the instrumentalities supported by said support may, either alternatively to the lasting rolls or in addition thereto, comprise adhesive applying nozzles by which adhesive can be applied progressively between lasting marginal portions of the upper and corresponding marginal portions of the insole of a shoe supported by the shoe support arrangement, as relative movement is effected between the shoe support arrangement and said instrumentalities as aforesaid, the nozzles being mounted on said support for movement, independently of one another, in a direction extending widthwise of the bottom of a shoe supported by a shoe support arrangement, and the arrangement being such that, at the start of an operating cycle, the nozzles are first located, adjacent one another, in engagement with the insole of the shoe to be operated upon, whereafter they are moved outwardly to a position determined by the edge contour of the shoe bottom, relative lengthwise movement thereafter being effected between the nozzles and the shoe support arrangement as aforesaid. For following the edge contour of the shoe bottom, furthermore, the machine may be arranged so that the lasting margins are supported projecting beyond the surfaces of the insole, so that the upstanding lasting margin forms a "wall" against which the nozzles can be urged; alternatively, each nozzle may be provided with a latching device which is arranged to engage with the insole edge, the nozzle then being urged inwardly to maintain such latching device in engagement with the edge of the insole.

Whichever arrangement is used to control the path of operation of the nozzles, stop means may be provided, having an operative condition, in which the nozzles are positioned, adjacent one another, symmetrically at opposite sides of the longitudinal center line of the machine, or offset from said line (according to whether the support is in a first or second position), and a retracted condition, in which said stop means do not impede the movement of the nozzles in following the shoe edge contour as aforesaid, the arrangement being such that the stop means is in its operative condition at the start of an operating cycle of the machine, thus to ensure that the nozzles are adjacent one another when located in an initial position in engagement with the insole as aforesaid. In this way, it can be ensured that firstly the nozzles are brought into contact with the insole regardless of the shoe bottom contour, while once the movement of the nozzles following the edge contour of the shoe bottom is initiated, the nozzles are not prevented from following such edge contour, even where it is required to cross the longitudinal center line of the machine in order to do so.

Conveniently, the stop means comprises, for each nozzle, a lever engagable by an abutment fixedly connected to the nozzles, the lever being held in operative condition or retracted therefrom by fluid pressure operated means, and resilient means being provided for urging the abutment member into engagement with the lever and thus serving, when the lever is moved to its retracted condition, to urge the nozzles to follow the shoe edge contour.

BRIEF DESCRIPTION OF THE DRAWINGS

The object and advantages of the present invention will become more apparent when viewed in conjunction with the following drawings, in which.

DESCRIPTION OF THE PREFERRED EMBODIMENTS

Figure 1:
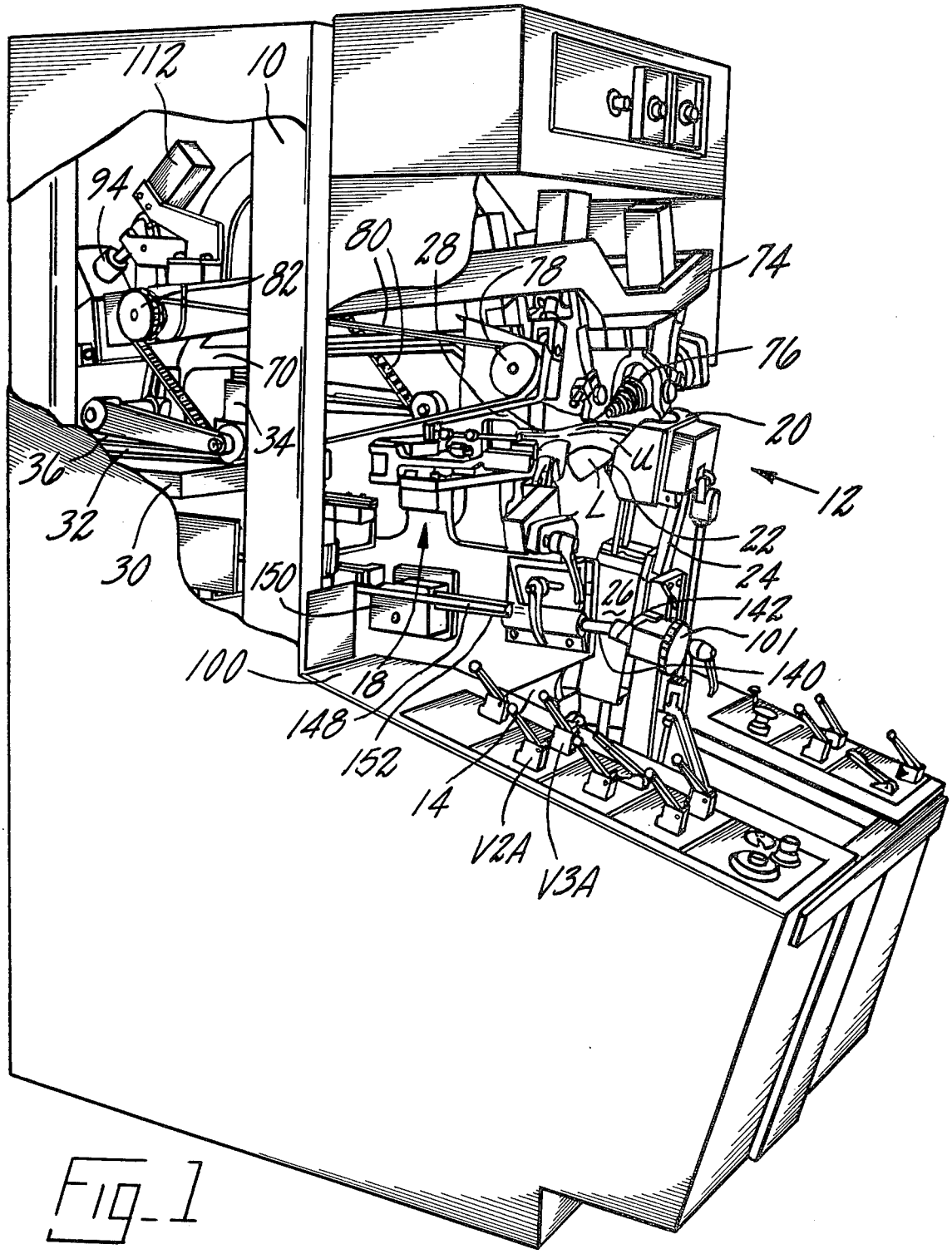
FIG. 1 is a perspective view of the present invention, viewed from the left-hand side of the front thereof.

The present invention is a machine for lasting side portions of shoes and is generally similar, except as hereinafter described, to the machine disclosed in U.S. Pat. No. 3,849,817. Thus, the machine comprises a main frame 10 as shown in FIG. 1, which supports a shoe support arrangement generally designated 12 for movement fore-and-aft of the machine, i.e. in a direction extending lengthwise of the bottom of a shoe supported thereby. The shoe support arrangement comprises a last post 14 having an upstanding last pin (not shown) on which a last L carrying a shoe upper U and insole I can be supported, bottom uppermost, means (not shown) being provided for swinging the last post 14 from a loading position into an operative position in which the heel end of the shoe supported thereby is clamped by a heel and side clamp arrangement generally designated 18. In addition, the shoe support arrangement 12 comprises a toe end engaging member 20 and a toe rest 22, said member and toe rest being carried by a support 24 which is mounted for pivotal movement to bring the member 20, which is generally U-shaped to accommodate the toe end, the arrangement being such that the member 20 serves to position the shoe in the shoe support arrangement in a desired relationship with the longitudinal center line of the machine. A piston-and-cylinder arrangement 26 is provided for moving the toe rest 22 heightwise, and a holddown member 28 is associated with the heel and side clamp arrangement 18 for determining the heightwise position of the shoe in the shoe support arrangement.

The frame 10 of the present inventive machine includes a base plate 30 to which is secured an auxiliary base plate 32 carrying at its forward end an upstanding pivot post 34 on which a support plate 36 is carried by which various instrumentalities of the machine are supported, as will be hereinafter described. For assisting the pivoting of the support plate 36, the base plate 32 carries two bearing arrangements generally designated 35, shown in FIG. 2, which engage with the under-side of the support plate 36. At the end of the plate 36 remote from the pivot post 34, furthermore, a roll 37 is mounted on a bracket carried on the base plate 30, said roll being arranged to act on an upper surface of the support plate 36 to urge it downwardly on to the bearing arrangements.

For effecting pivotal movement of the support plate 36, support-moving means is provided comprising a piston-and-cylinder arrangement 38, mounted on the auxiliary base plate 32, and carrying a slide member 40 arranged to slide in a T-shaped groove of a channel member 42, the slide member 40 carrying an upstanding pin 44 which is accommodated in a cam slot 46 of a cam plate 48 secured to, but spaced apart from, the upper surface of the support plate 36. Mounted on a pin 50 secured between the cam plate 48 and auxiliary base plate 32 is a cam member 52 having two cam faces, the arrangement being such that the cam member can be moved in relation to the cam slot 46 so that one or other of its cam faces projects into said slot and can be engaged by the pin 44 as aforesaid. For moving the cam member a piston-and-cylinder arrangement 54 is provided, also secured between the cam plate 48 and the auxiliary base plate 32, and further, for determining the two positions of the cam member 52, stops 56 are provided.

In the operation of the machine, the piston-and-cylinder arrangement 58 is actuated to move the pin 44 between a first operative position, in which the pin is out of engagement with the cam member 52, and a second operative position in which the pin is located in engagement with a selected one of the cam faces of the cam member 52, according to the operation of the piston-and-cylinder arrangement 54. The effect of thus moving the pin 44 is to cause the cam plate 48, and thus the support plate 36 bolted thereto, to pivot about the pivot post 34, thus to move said support plate between a first position, corresponding to the first operative position of the pin 44, and a selected one of two second positions, corresponding to the second operative position of the pin 44. A bolt 57 is threaded into an upstanding bracket 58 on the slide member 40 and passes through a further upstanding bracket 59 on the outside of the cylinder, the bolt 57 having a headed portion which abuts against said upstanding bracket 59 thus to limit the stroke of the piston-and-cylinder arrangement 38, and thus the amount of movement of the pin 44 from its first operative position to one of its second operative positions.

Figure 3:
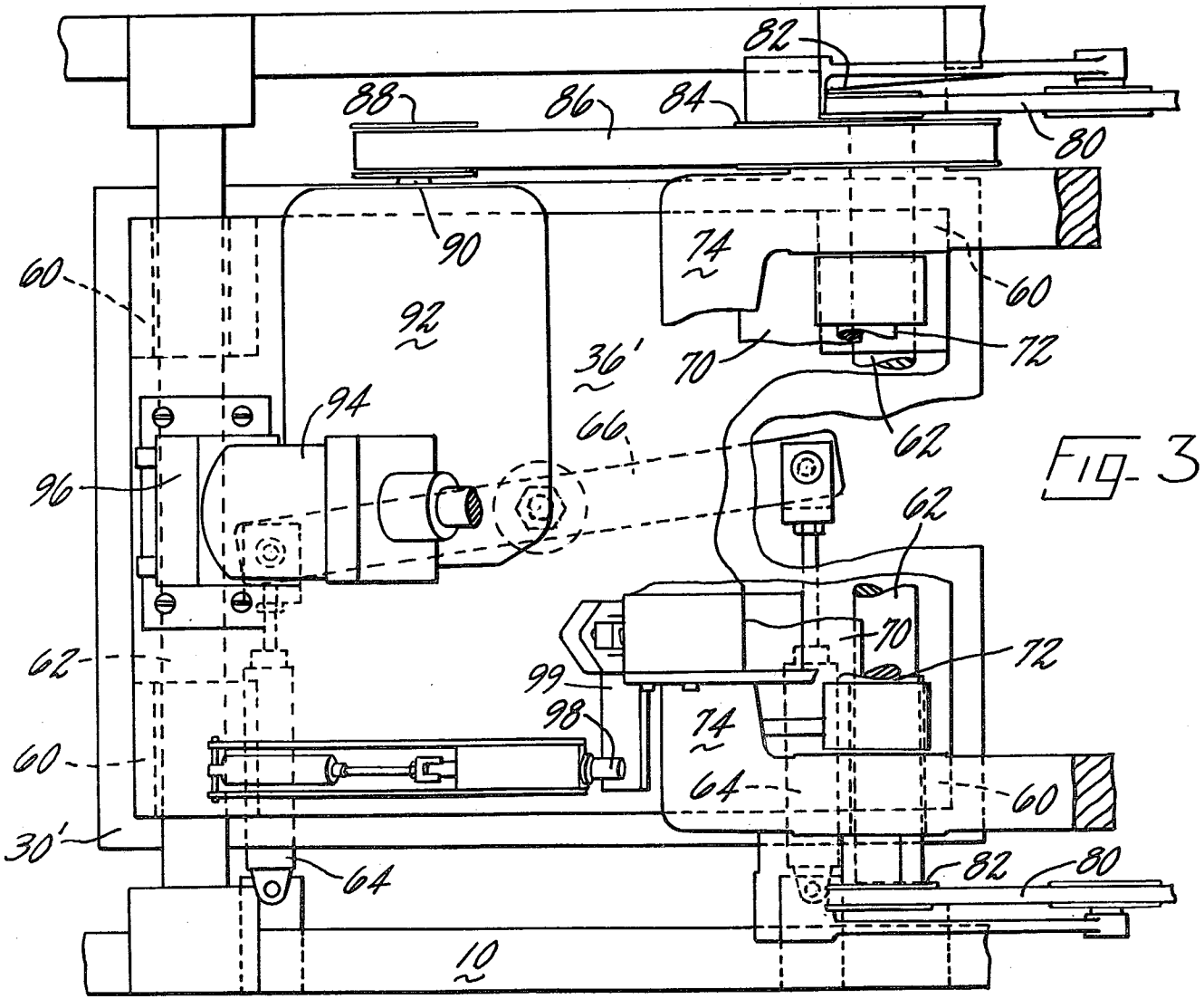
FIG. 3 is a view, generally similar to FIG. 2, of the modification of the present invention.

In the modification of the machine, as shown in FIG. 3, the main frame 10 comprises a base plate 30' on which are mounted four blocks 60, two at either sides thereof, each set of two blocks supporting therebetween a slide rod 62 on which is mounted, for sliding movement in a direction extending widthwise of the bottom of a shoe supported by the shoe support arrangement, a support plate 36'. For moving the support plate 36' widthwise of the machine, an actuating means is provided including two pusher members in the form of piston-and-cylinder arrangements 64 mounted on the main frame 10 with their piston rods extending beneath the plate 36' and being pivotally connected to opposite ends of a lever 66 mounted for pivotal movement on the under side of the plate 36'.

In the operation of the modified machine, the support plate 36' is thus movable between a first position and two second positions, arranged at opposite sides of first position, in a direction widthwise of the machine. To this end, the piston-and-cylinder arrangements 64 are double-acting, the arrangement being such that with both piston rods thereof in an extended condition the support plate 36' is in one of its second positions, while with the piston rods in a retracted condition said plate is in the other of its second positions, but with one of the piston rods in an extending condition and the other in a retracted condition the support plate is in its first position.

Figure 2:
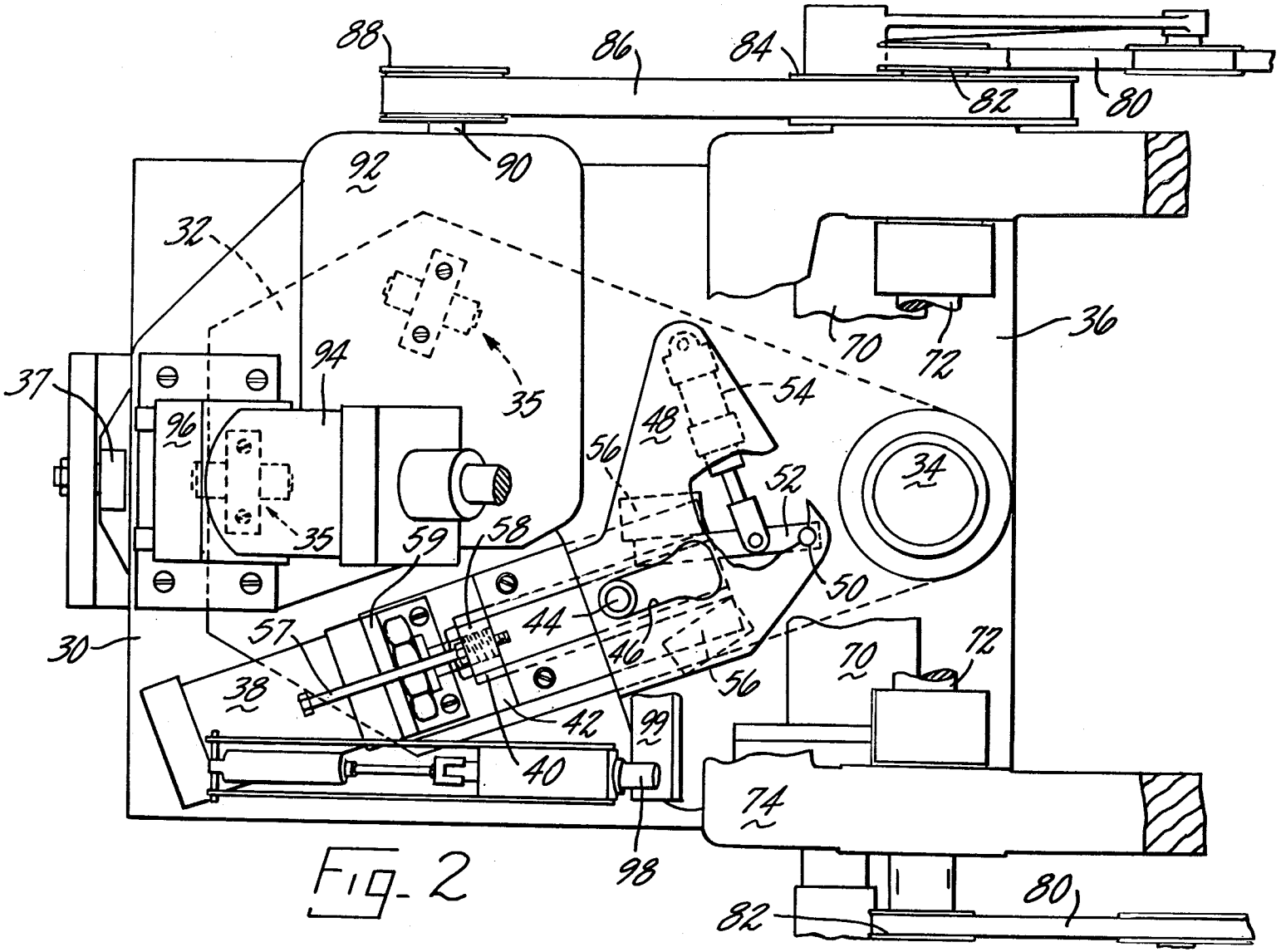
FIG. 2 is a fragmentary plan view showing details of a support for instrumentalities of the present invention.
Figure 4:
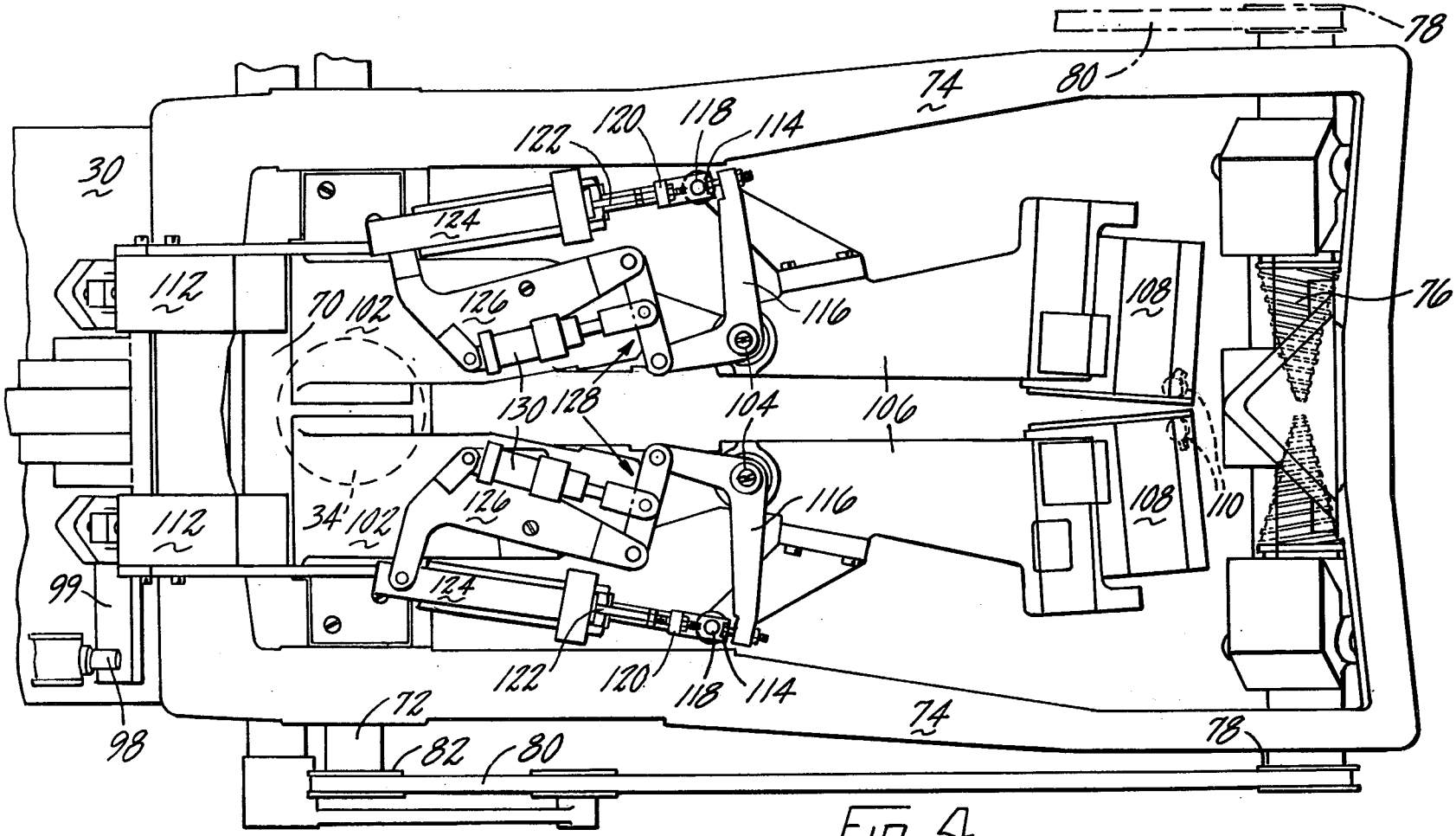
FIG. 4 is a plane view showing details of the instrumentalities, i.e. lasting rolls and adhesive applying nozzles.

Whichever mounting arrangement is provided for the support plate 36 (36'), the plate carries, at its forward end, a bridge member 70 carrying a transverse support shaft 72 by which a support frame 74 is pivotally mounted in the machine, said frame carrying at its forward end side lasting instrumentalities in the form of lasting rolls 76, shown in FIG. 4. The lasting rolls are generally conical, with the apices adjacent one another, each roll being rotatable about an axis extending widthwise of the bottom of ashoe supported by the shoe support arrangement and each being provided with a wiping element disposed helically about the circumference thereof. A drive arrangement is provided for rotating the rolls, including a first pulley 78 operatively connected to its associated lasting roll, and connected by a drive belt 80 to a second pulley 82 rotatable about an axis coincident with the axis of the support shaft 72, a further, larger diameter, pulley 84 being also rotatable on said axis and being fixedly connected to the pulley 82, as shown in FIG. 2, said further pulley 84 being driven through a drive belt 88 from a pulley 88 on an output drive shaft 90 of an electric motor 92 mounted on the support plate 36 (36'). Furthermore, for moving the lasting rolls heightwise into and out of engagement with the bottom of a shoe to be operated upon, the support frame 74 is caused to pivot about the support shaft 72 by means of a piston-and-cylinder arrangement 94 connected to the support frame at the rear end thereof and being mounted on a bracket 96 at the rear of the support plate 36 (36'). In order to ensure that the lasting rolls are not damaged due to the support frame 74 sinking about its pivot when the fluid under pressure is removed from the piston-and-cylinder arrangement 94, e.g. at the end of a working shift, a stop member 98 is provided engaging an abutment face 99 on the frame when fluid under pressure is no longer supplied to the piston-and-cylinder arrangement 94, said stop member 98 being itself held retracted by fluid pressure operated means, not shown during normal working of the machine and being spring-urged into operative condition when said means is de-actuated.

The machine, and also the modification thereof, is so arranged that, when the support plate 36 (36') is in its first position the lasting rolls are positioned symmetrically at opposite sides of the longitudinal center line of the machine, while when the support is in one of its second positions, said instrumentalities are positioned offset from said longitudinal center line, the selection of which of the second positions being determined according to whether the shoe to be operated upon is a left or a right.

The selection of the appropriate second position of the support is determined by one of two valves V1A, V1B, not shown, which are arranged to be selectively actuated, one being positioned on each side of the support 24 by which the toe end engaging member 20 and toe rest 22 are supported, said support being movable in a direction extending widthwise of the bottom of a shoe supported by the shoe support arrangement between two positions, according to whether the shoe to be operated upon is a left or a right. (The positions of the support are adjustable under the control of the operator, using such adjustment knob 101, shown in FIG. 1, which is provided with a graduated scale, indicating different styles of shoes to be operated upon.)

In the machine, actuation in a proper circuit of one of the valves V1A, V1B determines the condition of the piston-and-cylinder arrangement 54, and thus the condition of the cam member 52. In addition, however, the position of the support plate 36 is determined according to the position of the pin 44 in the cam slot 46, this being under the control of the piston-and-cylinder arrangement 38, admission of fluid under pressure to which is controlled by a valve arrangement comprising valves V2A, V2B and V2C. Through valve V2A, which is manually operable by the operator and is positioned on the control panel 100, shown in FIG. 1, of the machine, valves V2B and B2C are included in or excluded from the supply circuit for fluid under pressure to the piston-and-cylinder arrangement 38. Valve V2B (not shown) is effective, subject to the control of valve V2A, to allow fluid under pressure to one side of piston-and-cylinder arrangement 38, thus to cause the pin 44 to engage with the cam surface of the cam member 52, whereby the support plate 36 is moved to the selected one of its second positions, said valve being actuated upon actuation of the appropriate one of valves V1A, V1B. Valve V2C is effective, subject to the control of valve V2A, to reverse the flow of fluid under pressure via valve V2B to the other side of said arrangement 38, thereby moving the pin 44 out of engagement with the cam face, and thus returning the support plate 36 to its first position; acutation of valve V2C takes place during the operating cycle of the machine, as will be hereinafter described. In addition, valve V2C is effective to allow fluid under pressure to the piston-and-cylinder arrangement 54 shown in FIG. 2, to cause the cam member 52 to be urged thereby out of the position to which it was moved upon actuation of the appropriate one of valves V1A, V1B to its other position, such movement being completed upon retraction of the pin 44 to its first operative position.

Further for controlling the movement of the support plate 36 in the machine, a further valve arrangement, comprising valves V3A, V3B, is provided. By valve V3A, which is manually operable by the operator and is located on the control panel 100 of the machine, valve V3B is included in or excluded from the supply circuit to the piston-and-cylinder arrangement 38. Actuation of valve V3B, which takes place during the operation cycle of the machine by means to be described hereinafter, is effective, subject to the control of valve V3A, once more to reverse the flow of fluid under pressure to said arrangement 38 to cause the pin 44 to move from its first to second operative position, thereby once more causing the support plate 36 to move to a second position; in this case, however, the second position will not be as determined at the start of the operating cycle by one of valves V1A, V1B, but rather the other second position thereof.

Figure 7:
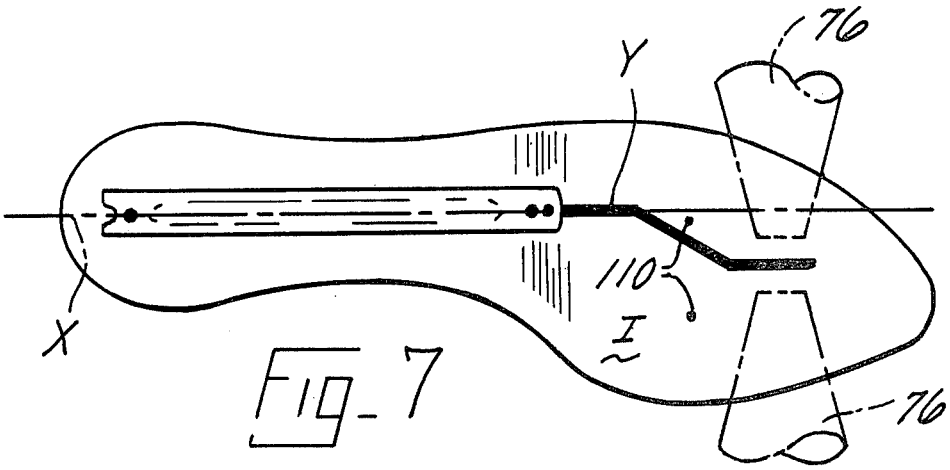
FIGS. 7 to 9 are diagrams of three shoe bottoms of different edge contour, and illustrating the movement of the support for the instrumentalities in relation to each such shoe bottom in the operation of the machine constructed according to the principles of the present invention.

The machine is thus capable of operating in a number of operating modes. In a first operating mode, as shown in FIG. 7, with the shoe to be operated upon positioned with a longitudinal center line of its shank region aligned with the longitudinal center line X of the machine, e.g. where the shoe is provided with a metal shank, valve V2A will be positioned to incorporate valves V2B, V2C in the supply circuit to the piston-and-cylinder arrangement 38 so that, at the start of an operating cycle, the support plate 36 is in one of its second positions, determined according to whether the shoe to be operated upon is a left or a right. In the course of the operating cycle, upon actuation of valve V2C, the supply of fluid under pressure to said piston-and-cylinder arrangement 38 is referred, thus retracting the pin and causing the support plate 36 to move to its first position. In this way, the lasting rolls 76 will be positioned symmetrically on opposite sides of the longitudinal center line of the machine as they operate progressively along the shank region of the shoe bottom, thereby avoiding fouling of the rolls on the metal shank. Further Y indicates the roll path.

Figure 8:
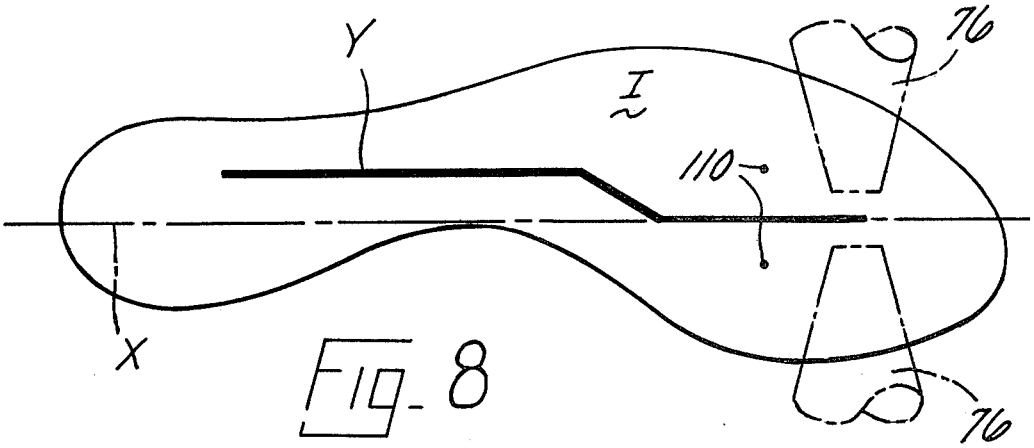

Further, in a second operating mode, as shown in FIG. 8, the shoe to be operated upon is positioned with a longitudinal center line of its shank region inclined to the longitudinal center line of the machine, and in this case the valve V2A is positioned to exclude valves V2B, V2C from the supply circuit, while valve V3A is positioned to incorporate valve V3B in said circuit. The exclusion of valve V2B ensures that the pin 44 remains in its first operative position, so that at the start of an operating cycle the support plate 36 is in its first position. During the operating cycle, furthermore, actuation of valve V2C will be ineffective to move the pin 44, but will be effective to shift the cam member 52 to its other position. Thereafter, actuation of the valve V3B will be effective to reverse the flow of fluid under pressure to said arrangement 38, thereby moving the pin to its second operative position and causing thus the support plate to move to its second position.

Figure 9:
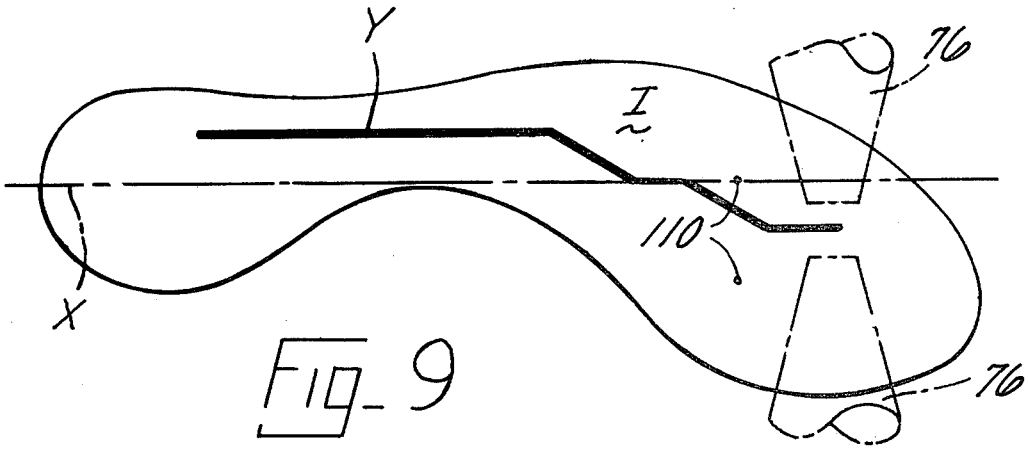

Again, in a third operating mode of the machine, as shown in FIG. 9, the shoe to be operated upon is positioned with a longitudinal center line of its shank region extending parallel, or substantially so, to the longitudinal center line of the machine, and in this case the valves V2A, V3A are so positioned as to incorporate all the valves V2B, V2C, V3B in the supply circuit to piston-and-cylinder arrangement 38. Thus, at the start of an operating cycle, the support plate will be in one of its second positions, and will be moved upon actuation of valve V2C, to its first position, and thereafter, upon actuation of valve V3B, will be moved to the other of its second positions.

In the modified machine, on the other hand, while the general principles of operation remain the same as with the above-described machine, actuation in a proper circuit of either one of valves V1A, V1B is effective to cause a supply circuit to the piston-and-cylinder arrangements 64 to be closed subject to valve V2A being switched to incorporate valves V2B, V2C in such supply circuit. In such a case, the supply of fluid under pressure to one or other end of each of the piston-and-cylinder arrangements 64 will be effective to move the support plate 36' to one of its second positions. Upon tripping valve V2C, during the operating cycle of the machine, the supply to one of said piston-and-cylinder arrangements 64 will thereby be reversed, thus causing the support plate 36' to move to its centralized first position. Similarly, with valve V3A switched to a position in which valve V3B is incorporated in the supply circuit, tripping valve V3B during the operating cycle of the machine will be effective to cause the support plate 36' to move to the other of its second positions, in the same manner as in the operation of the illustrative machine.

Where both valves V2A, V3A are switched to "operative" condition, incorporating valve V2B, V2C, V3B in the supply circuit, the valves V2C, V3B are so arranged in relation to one another, and in relation to the speed at which the shoe support arrangement 12 moves relative to the lasting instrumentalities, that the support plate will not be arrested in its first position, but rather will pass through said first position from one second position to the other.

Figure 5:
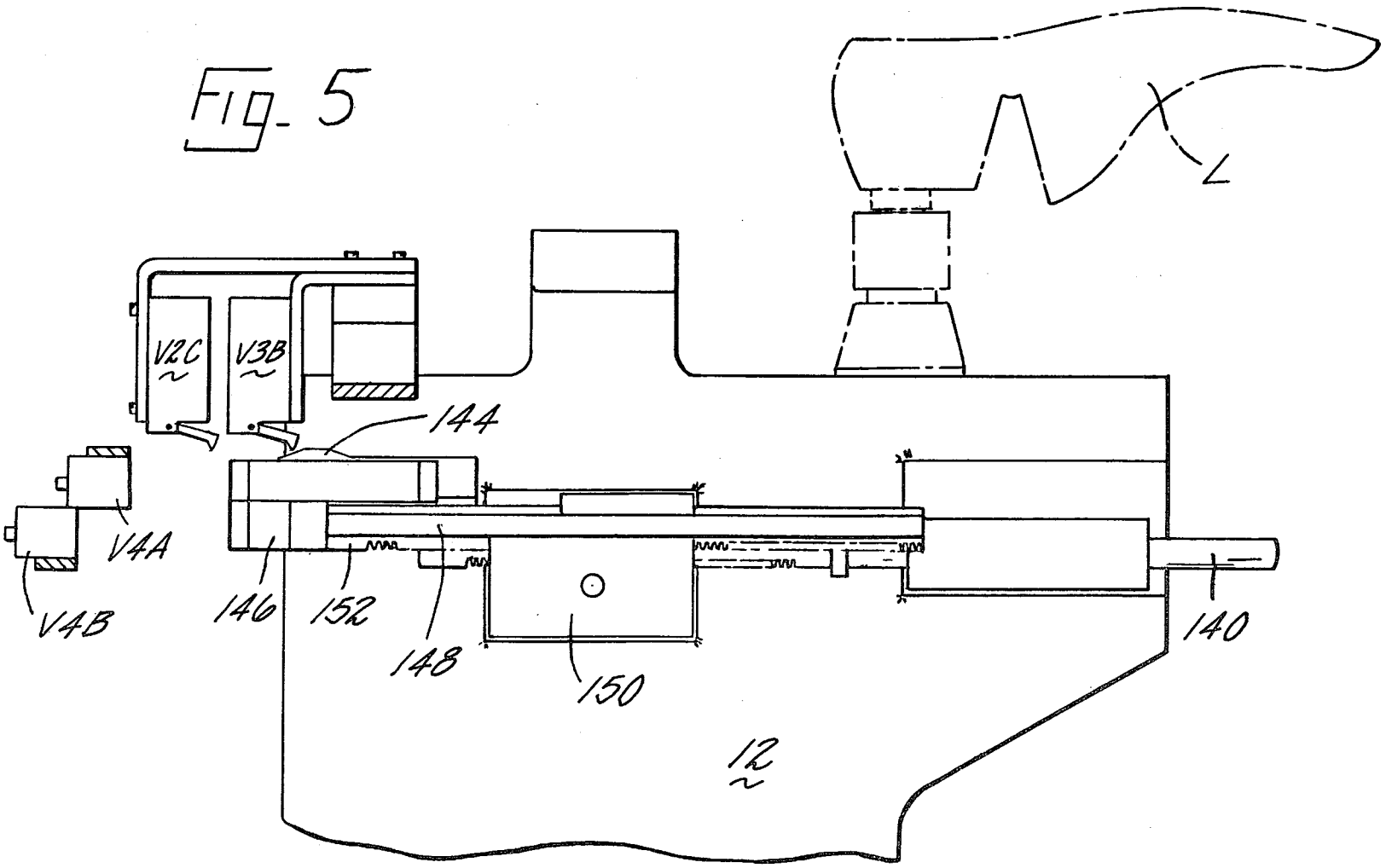
FIGS. 5 and 6 are respectively fragmentary plan and side views of actuating means for valve means by which movement of a support plate of the machine is caused to take place between first and second positions.
Figure 6:
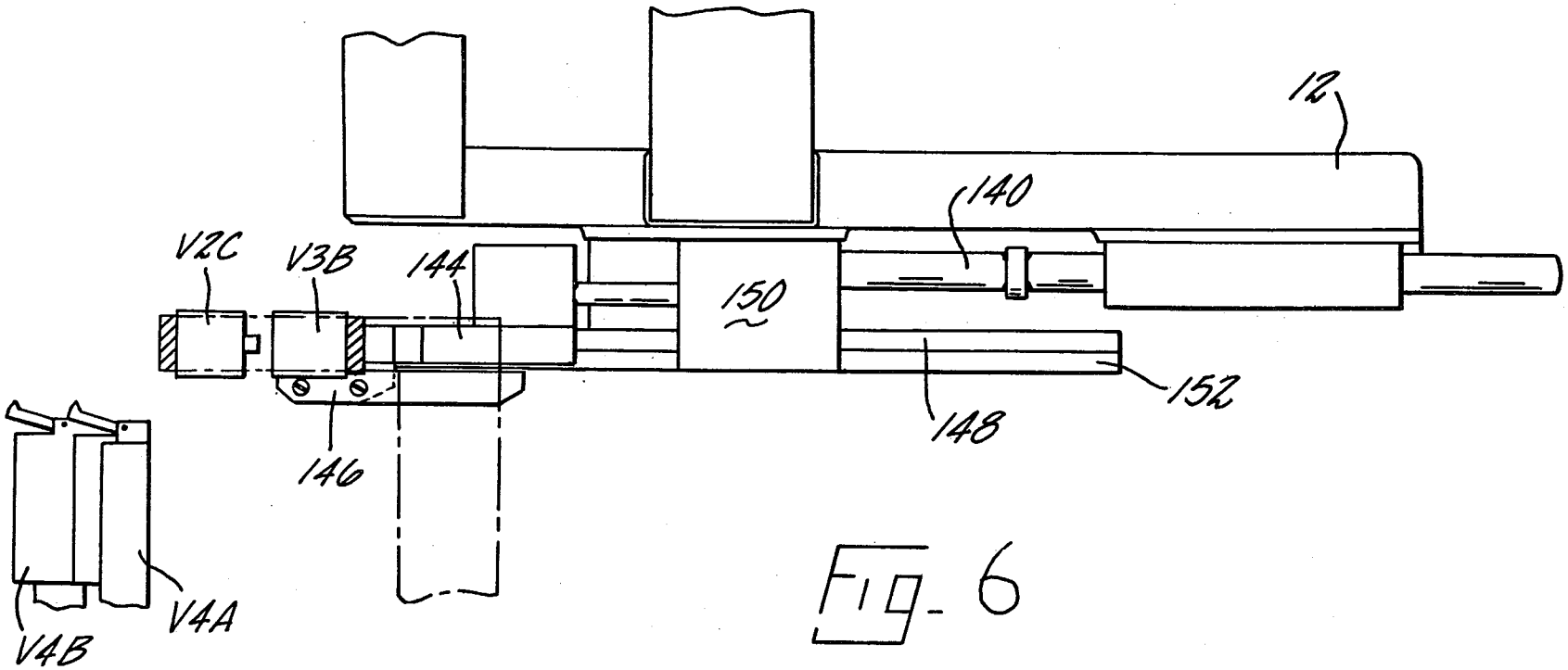

For acutating valves V2C, V3B as aforesaid in the operation of the preferred or modified machine, actuating means is provided, comprising a rod 140, shown in FIGS. 5 and 6, enabling movement in a direction extending lengthwise of the bottom of a shoe supported by the shoe support arrangement. For moving the rod an abutment 142 is provided associated with the knob 101, said abutment being thus adjustable according to the styles of shoe to be operated upon, and the arrangement being such that, as the support 24 moves to bring the toe end engaging member 22 into engagement with the toe end of the shoe to be operated upon, the abutment 142 engages the end of the rod 140 and moves it into a position determined according to the length of the shoe. Furthermore, the abutment 142 is so positioned on the support 24 that the ratio between the distance from the pivot of said support to the abutment and the distance from said pivot to the shoe toe end engaged by the toe end engaging member 20 is equal, or substantially so, to the ratio between the distance from the heel end of the shoe to the ball region of the bottom of the shoe and the overall length of the shoe. Thus, the movement of the rod 140 varies, between successive shoes to be operated upon, as the heel-end-to-ball-region dimension of the shoe varies.

When the rod 140 has been positioned as aforesaid, it is locked in its adjusted position during subsequent movement of the shoe support arrangement 12 relative to the side lasting instrumentalities. The rod 140 carries a cam member 144, shown in FIG. 5, which is arranged to actuate the valves V2C, V3B in sequence, as movement of the shoe support arrangement 12 is effected relative to the lasting instrumentalities as aforesaid. Since the rod 140 is positioned in relation to the ball region of the shoe being operated upon, it will be appreciated that actuation of the valves by the cam member 144 will be effected in relation to the position of the ball region of such shoe.

Also mounted for pivotal movement about the axis of the shaft 72, in both the preferred and modified machines, are two support members 102 at the end, remote from the shaft 72, of each of which is carried a vertical pivot pin 104, one each of which is carried a support arm 106, as shown in FIG. 4. Each arm 106 in turn carries a melt chamber 108 and an adhesive applying nozzle 110 operatively connected to the melt chamber 108. By this mounting arrangement, each nozzle 110 is capable, independently of the other, of pivoting heightwise about the axis of the shaft 72 and widthwise, each about the axis of its pin 104, in relation to the bottom of a shoe to be operated upon. For effecting such pivotal heightwise movement, furthermore, each nozzle 110 has associated therewith a piston-and-cylinder arrangement 112 secured on the bridge member 70. The nozzles 110 are arranged to apply adhesive progressively between lasting marginal portions of the upper and corresponding marginal portions of the insole of a shoe supported by the shoe support arrangement 12, as the latter is moved relative to the side lasting instrumentalities and nozzles as aforesaid.

For controlling the position of each nozzle, widthwise of the shoe bottom to be operated upon, at the start of a cycle of operation of the machine, stop means is provided in the form of a headed bolt 114, shown in FIG. 4, which is adjustably mounting in one end of an arm of a bell crank lever 116 itself mounted for pivotal movement about the axis of the pin 104, the headed bolt 114 being arranged to be engaged by an abutment pin 118 carried by a bracket 120 on the support arm 106 of the nozzle associated with the stop means, said pin 118 being connected to a piston rod 122 of a piston-and-cylinder arrangement 124 supported on a bracket 126 carried by the support member 102. For positioning the belt crank lever 116, and thus the headed bolt 114, the other arm of the bell crank lever is connected to a toggle arrangement generally designated 128, which is also connected to the bracket 126, said bracket also supporting a piston-and-cylinder arrangement 130 for making and breaking the toggle. The stop means is so constructed and arranged that when the toggle is "made" the headed bolt 114 is in an operative condition, while when the toggle is in a "broken" condition, the headed bolt is removed to a retracted condition, out of the path of movement of the abutment pin 118 associated therewith.

With both headed bolts 114 of the stop means in an operative condition, the nozzles 110 are positioned adjacent one another, symmetrically at opposite sides of the longitudinal center line of the machine or offset from said line, as shown in FIGS. 7 to 9, according to whether the support plate 36 (36') is in a first or second position, while with said bolts in a retracted condition, the stop means does not impede the movement of the nozzles 110 in following the shoe edge contour as aforesaid.

In the operation of the preferred or modified machine, the stop means is arranged to be in its operative condition, namely by energizing the piston-and-cylinders 130 to "make" the toggle arrangement 128, at the start of a cycle of operation of the machine, prior to the nozzles being lowered on to the surface of the shoe bottom. Thereafter the stop means is moved to its retracted condition, by de-actuating said piston-and-cylinder arrangements 130, at the same time as the nozzles are caused to move outwardly to engage the shoe bottom edge.

It will thus be appreciated that, in using the preferred or modified machine, the lasting rolls 76 and also the adhesive applying nozzles 110 can be caused to engage with the shoe bottom at an appropriate position according to the shape of the shoe bottom, namely in an offset position or a position of symmetry along the longitudinal center line of the machine according to the setting of the various valve means of the machine, and thereafter, while, during an operating cycle of the machine, the lasting roll position widthwise of the shoe bottom is controlled through the various valve means, the adhesive applying nozzles are able to follow the edge contour of the shoe bottom regardless of the relationship of the shoe bottom edge contour and the longitudinal center line of the machine.

The adhesive applying nozzles 110 are brought into engagement with the insole I of a shoe in advance of the lasting rolls engaging the lasting marginal portions of the shoe upper as aforesaid. To this end, when the shoe support arrangement 12 is moved relative to the support plate 36 (36'), and thus to the nozzles, the piston-and-cylinder arrangements 112 are first actuated, and thereafter the piston-and-cylinder arrangement 94. For actuating said piston-and-cylinder arrangements, two valves V4A, V4B shown in FIGS. 5 and 6, are provided, said valves being actuated by means of a cam member 146 mounted on a rod 148 which is supported for movement, in a direction extending lengthwise of the bottom of a shoe being operated upon, by the shoe support arrangement 12. The rod 148 is caused to move as the rod 140 moves, movement of the rod 148, however, being proportionately increased, through a set of gears accommodated in a gear housing 150, the output gear of said set acting on a rack 152 integral with the rod 148, the step-up ratio of the gears being such that the position of the cam member 146 varies with variation in the overall length of successively presenting shoes, rather than with variations in the heel-end-to-ball-region dimension thereof. The cam member 146 has two cam faces and is arranged to operate the valves V4A, V4B in sequence. Actuation of valve V4A is effective to arrest the lengthwise movement of the shoe support arrangement in order to allow the nozzles to descend into engagement with the insole, the arrangement being such that the point at which the nozzles engage the insole is at a fixed distance, according to the style, from the toe end of the shoe. Thereafter, the relative movement is caused to continue, when the nozzles have moved outwardly to a position determined by the edge contour of the shoe bottom, to cause the nozzles to track toewardly until again arrested by actuation of valve V4B. In this way, the nozzles are able to move beneath the "scroll" formed during the toe lasting operation, which precedes the side lasting operation using the preferred or modified machine. Thereafter, the direction of relative movement of the shoe support arrangement 12 is reversed to enable the nozzles to track along the sides of the shoe bottom, following the edge bottom contour thereof, and the lasting rolls are caused to descend into engagement with the lasting marginal portions of the upper thus to wipe said portions inwardly over the insole edge and secure them to corresponding marginal portions of the insole.

We claim:

1. A machine for lasting side portions of shoes comprising:

a shoe support arrangement by which a last carrying a shoe upper and an insole can be positioned and which includes means serving to position the shoe in a desired relationship with the longitudinal center line of the machine;

instrumentalities for operating on side portions of a shoe supported by the shoe support arrangement;

means for effecting relative movement between the shoe support arrangement and said instrumentalities in a direction extending lengthwise of a shoe supported by the shoe support arrangement, whereby the instrumentalities are caused to operate progressively along opposite side portions of such shoe, wherein the instrumentalities are mounted on a support which is movable between a first position, in which the instrumentalities can be positioned symmetrically at opposite sides of the longitudinal center line of the machine, and a second position, in which said instrumentalities can be positioned offset from said line;

a support moving means is provided for moving the support between its first and second positions, the arrangement being such that the support is positioned in a selected one of its first and second positions at the start of an operating cycle of the machine and is moved by the support-moving means to the other of said positions during said operating cycle;

said support being movable between its first position and a selected one of two second positions, in which said instrumentalities can be positioned offset from the longitudinal center line of the machine, said two second positions of the support being arranged symmetrically at opposite sides of the first position thereof, and the arrangement being such that the support is caused to be moved as aforesaid during an operating cycle of the machine between its first position and one of its second positions selected according to whether the shoe being operated upon is a left or a right;

said instrumentalities comprising side lasting instrumentalities;

said support-moving means for the support for the side lasting instrumentalities as they are moved between its first and second positions comprises cam means; and wherein said cam means comprises a cam member having two cam faces and means for moving said member so as to enable one or other of said faces to be engaged by an abutment member, the arrangement being such that, in an operating cycle of the machine, relative movement is caused to take place over a predetermined distance between the cam member and the abutment member between a first operative position in which they are out of engagement with one another, in which position the support for the side lasting instrumentalities is in its first position, and a second operative position in which the abutment is located in engagement with one or other of the cam faces, and further that, with cam member and abutment member in such second operative position, when one of said cam faces is engaged by the abutment member said support is in one of its second positions, and when the other cam face is so engaged, said support is in the other of its second positions.

2. A machine for lasting side portions of shoes as recited in claim 1, wherein said cam means comprises a cam plate having a cam slot in which an abutment member is accommodated, the support-moving means also comprising a fluid pressure operated means for effecting relative movement between said cam plate and abutment member.

3. A machine for lasting side portions of shoes as recited in claim 1, wherein the abutment member is accommodated in a cam slot of a cam plate, the arrangement being such that the cam member is moved in relation to the cam slot so that one or other of its cam faces projects into said slot and can be engaged by the abutment member as aforesaid, and further wherein the cam means comprises fluid pressure operated means for effecting relative movement between the cam plate, and thus the cam member, and the abutment member between said first and second operative positions.

4. A machine for lasting side portions of shoes as recited in claim 3, wherein the means for moving the cam member as aforesaid is also fluid pressure operated.

5. A machine for lasting side portions of shoes as recited in claim 2, wherein said cam plate is fixedly connected to the support for the side lasting instrumentalities, and the abutment member is carries by the fluid pressure operated means.

6. A machine for lasting side portions of shoes as recited in claim 5, wherein the support for the instrumentalities is mounted for pivotal movement between its first and second positions.

7. A machine for lasting side portions of shoes as recited in claim 3, wherein the support for the instrumentalities is mounted for sliding movement bodily between its first and second positions.

8. A machine for lasting side portions of shoes as recited in claim 7, wherein an actuating means, including two pusher members acting on a lever pivotally connected to the support, is provided for moving the support as aforesaid, the arrangement being such that with both pusher members in an extended condition the support is in one of its second positions, while with the pusher members in a retracted condition the support is in the other of its second positions, but with one pusher member in an extended and the other in a retracted condition the support is in its first position.

9. A machine for lasting side portions of shoes as recited in claim 8, wherein a valve means is provided, actuatable by cam means, as relative movement is effected as aforesaid between the shoe support arrangement and the side lasting instrumentalities in a direction extending lengthwise of a shoe supported by the shoe support arrangement, to cause the support for the side lasting instrumentalities to be moved between its first and second positions as aforesaid, and wherein the initial relative position between said cam means and said valve means is determined according to the size of shoe being operated upon.

10. A machine for lasting side portions of shoes as recited in claim 9, wherein the initial relative position between said cam means and said valve means is determined according to the position of the ball region of the bottom of a shoe being operated upon in relation to the shoe support arrangement by which it is supported.

11. A machine for lasting side portions of shoes as recited in claim 10, wherein said instrumentalities comprise lasting rolls, each rotatable about an axis extending widthwise of the bottom of a shoe supported by the shoe support arrangement and each being provided with a wiping element disposed helically about the circumference thereof.

12. A machine of lasting side portions of shoes as recited in claim 11, wherein the shoe to be operated upon is positioned with a longitudinal center line of its shank region aligned with the longitudinal center line of the machine and further wherein, at the start of an operating cycle, the support for the side lasting instrumentalities is in its second position, or in one of its second positions selected according to whether the shoe being operated upon is a left or a right, and is moved to its first position as the side lasting instrumentalities supported thereby are operating in the ball region of said shoe and approaching the shank region thereof.

13. A machine for lasting side portions of shoes as recited in claim 11, wherein the shoe to be operated upon is positioned with a longitudinal center line of its shank region inclined to the longitudinal center line of the machine and further wherein, at the start of an operating cycle, the support for the side lasting instrumentalities is in its first position and is moved into its second position, or in one of its second positions selected according to whether the shoe being operated upon is a left or a right, as the side lasting instrumentalities supported thereby reach the shank region of said shoe.

14. A machine for lasting side portions of shoes as recited in claim 11, wherein the shoe to be operated upon is positioned with a longitudinal center lines of its shank region parallel, or substantially so, to the longitudinal center line of the machine, and further wherein, at the start of an operating cycle, the support for the side lasting instrumentalities is in one of its second positions, selected according to whether the shoe being operated upon is a left or a right, is moved to its first position as the side lasting instrumentalities operate in the ball region of said shoe, and is thereafter moved to the other of its second positions when said side lasting instrumentalities reach the shank region of said shoe.

15. A machine for lasting side portions of shoes as recited in claim 11, wherein the shoe to be operated upon is positioned with a longitudinal center line of its shank region extending parallel, or substantially so, to the longitudinal center line of the machine, and further wherein, at the start of an operating cycle, the support for the side lasting instrumentalities is in one of its second positions, selected according to whether the shoe being operated upon is a left or a right, and is moved to the other of its second positions, passing through its first position, as the side lasting instrumentalities supported thereby approach the shank region of said shoe.

16. A machine for lasting side portions of shoes as recited in claim 15, wherein said instrumentalities comprise, in addition to lasting rolls, adhesive applying nozzles by which adhesive can be applied progressively between lasting marginal portions of the upper and corresponding marginal portions of the insole of a shoe supported by the shoe support arrangement, as relative movement is effected between the shoe support arrangement and said instrumentalities as aforesaid, said nozzles being mounted on said support for movement, independently of one another, in a direction extending widthwise of the bottom of a shoe supported by the shoe support arrangement, and stop means being provided, having an operative condition, in which the nozzles are positioned, adjacent one another, symmetrically at opposite sides of the longitudinal center line of the machine or offset from said line according to whether the support is in a first or second position, and a retracted condition, in which said stop means do not impede the movement of the nozzles in following the shoe edge contour as aforesaid, the arrangement being such that the stop means is in its operative condition at the start of an operating cycle of the machine.

17. A machine for lasting side portions of shoes as recited in claim 16, wherein the stop means comprises, for each nozzle, a lever engagable by an abutment fixedly connected to the nozzle, the lever being held in operative condition or retracted therefrom by fluid pressure operated means, and resilient means being provided for urging the abutment member into engagement with the lever and thus serving, when the lever is moved to its retracted condition, to urge the nozzle to follow the shoe edge contour.

18. A machine for lasting side portions of shoes comprising:

a shoe support arrangement by which a last carrying a shoe upper and an insole can be positioned and which includes means serving to position the shoe in a desired relationship with the longitudinal center line of the machine;

instrumentalities for operating on side portions of a shoe supported by the shoe support arrangement;

means for effecting relative movement between the shoe support arrangement and said instrumentalities in a direction extending lengthwise of a shoe supported by the shoe support arrangement, whereby the instrumentalities are caused to operate progressively along opposite side portions of such shoe, wherein the instrumentalities are mounted on a support which is movable between a first position, in which the instrumentalities can be positioned symmetrically at opposite sides of the longitudinal center line of the machine, and a second position, in which said instrumentalities can be positioned offset from said line;

a support moving means is provided for moving the support between its first and second positions, the arrangement being such that the support is positioned in a selected one of its first and second positions at the start of an operating cycle of the machine and is moved by the support-moving means to the other of said positions during said operating cycle;

said support being movable between its first position and a selected one of two second positions, in which said instrumentalities can be positioned offset from the longitudinal center line of the machine, said two second positions of the support being arranged symmetrically at opposite sides of the first position thereof, and the arrangement being such that the support is caused to be moved as aforesaid during an operating cycle of the machine between its first position and one of its second positions selected according to whether the shoe being operated upon is a left or a right;

said instrumentalities comprising adhesive applying instrumentalities;

said support-moving means for the support for the adhesive applying instrumentalities as they are moved between its first and second positions, comprises cam means; and wherein said cam means comprises a cam member having two cam faces and means for moving said member so as to enable one or other of said faces to be engaged by an abutment member, the arrangement being such that, in an operating cycle of the machine, relative movement is caused to take place over a predetermined distance between the cam member and the abutment member between a first operative position in which they are out of engagement with one another, in which position the support for the adhesive applying instrumentalities in its first position, and a second operative position in which the abutment is located in engagement with one or other of the cam faces, and further that, cam member and abutment member in such second operative position, when one of said cam faces is engaged by the abutment member said support is in one of its second positions, and when the other cam face is so engaged, said support is in the other of its second positions.

* * * * *